US010033075B2

(12) United States Patent
Shiroyama et al.

(10) Patent No.: US 10,033,075 B2
(45) Date of Patent: Jul. 24, 2018

(54) CROSS COUPLED BAND-PASS FILTER

(71) Applicant: NEC Corporation, Tokyo (JP)

(72) Inventors: Norihisa Shiroyama, Kanagawa (JP); Sumio Ueda, Kanagawa (JP); Kiyotake Sasaki, Kanagawa (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 14/771,554

(22) PCT Filed: Feb. 27, 2014

(86) PCT No.: PCT/JP2014/001075
§ 371 (c)(1),
(2) Date: Aug. 31, 2015

(87) PCT Pub. No.: WO2014/132657
PCT Pub. Date: Sep. 4, 2014

(65) Prior Publication Data

US 2016/0006094 A1 Jan. 7, 2016

(30) Foreign Application Priority Data

Mar. 1, 2013 (JP) ..... 2013-040978

(51) Int. Cl.
*H01Q 1/50* (2006.01)
*H01P 1/20* (2006.01)
*H01P 1/207* (2006.01)

(52) U.S. Cl.
CPC ..... *H01P 1/20* (2013.01); *H01P 1/207* (2013.01); *H01Q 1/50* (2013.01)

(58) Field of Classification Search
CPC ..... H01Q 1/38; H01Q 3/08; H01Q 21/005; H01Q 13/10; H01Q 13/20
(Continued)

(56) References Cited

U.S. PATENT DOCUMENTS 2,922,122 A 1/1960 Harkless
6,166,612 A * 12/2000 Tsujiguchi ..... H01P 1/2013 333/134
(Continued)

FOREIGN PATENT DOCUMENTS

CN 1472842 A 2/2004
CN 201927690 U 8/2011
(Continued)

OTHER PUBLICATIONS

JP2010-28381A, Abstract.*
(Continued)

*Primary Examiner* — Dameon E Levi
*Assistant Examiner* — Collin Dawkins
(74) *Attorney, Agent, or Firm* — Finnegan, Henderson, Farabow, Garrett & Dunner, L.L.P.

(57) ABSTRACT

[Problem] To provide a cross coupled band-pass filter that reduces a loss of a signal due to a dielectric loss and enables a resonance frequency to be easily changed.
[Solution] A cross coupled band-pass filter of the present invention includes an input waveguide, an output waveguide, and three or more stages of resonators that connect the waveguides together, in which the three or more stages of resonators is formed using a filter element, one or multiple pairs of resonators of the three or more stages of resonators adjoin via a shared tube wall and include an opening in the shared tube wall, an antenna that connects the one or multiple pairs of resonators together in the opening, and one or more stages of unconnected resonators between the one or multiple pairs of resonators in a waveguide path of electromagnetic waves.

4 Claims, 11 Drawing Sheets

(58) Field of Classification Search
USPC ..... 343/850, 762, 771, 772
See application file for complete search history.

(56) References Cited

U.S. PATENT DOCUMENTS

| | | | | |
|---|---|---|---|---|
| 6,809,615 | B2 * | 10/2004 | Sonoda | H01P 1/20318 333/202 |
| 2003/0117243 | A1 | 6/2003 | Cooper | |
| 2007/0139135 | A1 | 6/2007 | Ammar et al. | |
| 2009/0237184 | A1 * | 9/2009 | Sarasa | H01P 1/209 333/208 |
| 2010/0308925 | A1 | 12/2010 | Song et al. | |

FOREIGN PATENT DOCUMENTS

| | | | | |
|---|---|---|---|---|
| CN | 202651322 | U | 1/2013 | |
| CN | 202712389 | U | 1/2013 | |
| EP | 0 104 735 | A2 | 4/1984 | |
| JP | 54-103655 | * | 8/1979 | H01P 1/20 |
| JP | 5-63407 | | 3/1993 | |
| JP | 2005-354698 | | 12/2005 | |
| JP | 4079944 | | 4/2008 | |
| JP | 2010-28381 | | 2/2010 | |
| JP | 2010-28381 | A * | 2/2010 | H01P 1/207 |
| JP | 2010-28381 | A * | 2/2010 | H01P 1/207 |
| JP | 2011-009806 | | 1/2011 | |

OTHER PUBLICATIONS

JP54-103655, Abstract.*

International Search Report and Written Opinion dated Apr. 22, 2014 in corresponding PCT International Application.

Japanese Office Action issued by the Japanese Patent Office in counterpart Japanese Application No. 2013-040978, dated May 9, 2017.

Chinese Office Action issued by the Chinese Patent Office in counterpart Chinese Patent Application No. 201480011981.8, dated Nov. 28, 2016.

P. Qiu et al., "Novel Ka-band Substrate Integrated Folded Waveguide (SIFW) Quasi-elliptic filters in LTCC", Microwave Conference, pp. 1-4, Dec. 2008.

E. Offli et al., "Novel E-Plane Filters and Diplexers With Elliptic Response for Millimeter-Wave Applications", IEEE Transactions on Microwave Theory and Techniques, IEEE Service Center, vol. 53, No. 3, pp. 843-851, Mar. 2005.

P. Kozakowski et al., "All Metal Insert E-plane Filter with Integrated Extracted Pole Resonator", Microwave Conference (EUMC), pp. 168-171, Oct. 2012.

Extended European Search Report issued by the European Patent Office in counterpart European Patent Application No. 14757763.9, dated Nov. 17, 2016.

* cited by examiner

CROSS COUPLED BAND-PASS FILTER

CROSS-REFERENCE TO RELATED PATENT APPLICATIONS

This application is a National Stage Entry of International Application No. PCT/JP2014/001075, filed Feb. 27, 2014, which claims priority from Japanese Patent Application No. 2013-040978, filed Mar. 1, 2013. The entire contents of the above-referenced applications are expressly incorporated herein by reference.

TECHNICAL FIELD

The present invention relates to a cross coupled band-pass filter used for filtering microwaves, millimeter waves, and the like.

BACKGROUND ART

In a wireless communication system that performs transmission/reception using a microwave or millimeter wave band, a band-pass filter is commonly used to pass only a signal of a desired frequency band and eliminate a signal of an unnecessary frequency band. At that time, to obtain a large attenuation amount of a frequency band in a periphery of a passband without increasing the number of stages of a filter, a so-called cross coupled filter having a pole on an attenuation characteristic is used.

As the cross coupled filter, disclosed are, for example, an E-plane finline band-pass filter using a finline for a resonance element (PTL 1, FIG. 9) and an E-plane finline band-pass filter including an external cavity (PTL 2, FIG. 10). In addition thereto, a band-pass filter having a structure where a pair of waveguide resonators is connected with each other via a connection hole (PTL 3, FIG. 11) is disclosed.

CITATION LIST

Patent Literature

[PTL 1] Japanese Patent Publication No. 4079944

[PTL 2] Japanese Laid-open Patent Publication No. 2005-354698

[PTL 3] Japanese Laid-open Patent Publication No. 2010-28381

SUMMARY OF INVENTION

Technical Problem

However, in the technique of PTL 1, due to a dielectric loss caused by a dielectric substrate 302 configuring the finline, a loss occurs in a signal. When a substrate or the like configuring the filter is exchanged and a resonance frequency of the filter is changed, in the configuration of PTL2, it is necessary to adjust a frequency of a cavity 207 separately disposed, using an adjustment screw or the like. In the technique of PTL 3, a shape of a resonator 2*a* included in a waveguide body determines a resonance frequency, and therefore it is difficult to change the resonance frequency.

The present invention has been made in view of such circumstances, and an object thereof is to provide a cross coupled band-pass filter that reduces a loss of a signal due to a dielectric loss and enables a resonance frequency to be easily changed.

Solution to Problem

To achieve the object, a cross coupled band-pass filter of the present invention includes an input waveguide, an output waveguide, and three or more stages of resonators that connect the waveguides together, wherein the three or more stages of resonators is formed using a filter element, one or multiple pairs of resonators of the three or more stages of resonators adjoin via a shared tube wall and include an opening in the shared tube wall, an antenna that connects the one or multiple pairs of resonators together in the opening, and one or more stages of unconnected resonators between the one or multiple pairs of resonators in a waveguide path of electromagnetic waves.

Advantageous Effects of Invention

The present invention can provide a cross coupled band-pass filter that reduces a loss of a signal due to a dielectric loss and enables a resonance frequency to be easily changed.

DESCRIPTION OF EMBODIMENTS

First Exemplary Embodiment

Exemplary embodiments of the present invention will be described in detail with reference to the drawings. However, the exemplary embodiments described below include technically preferable limitations to carry out the present invention, but the scope of the invention is not limited to the following.

Description of Configuration

Figure 1:
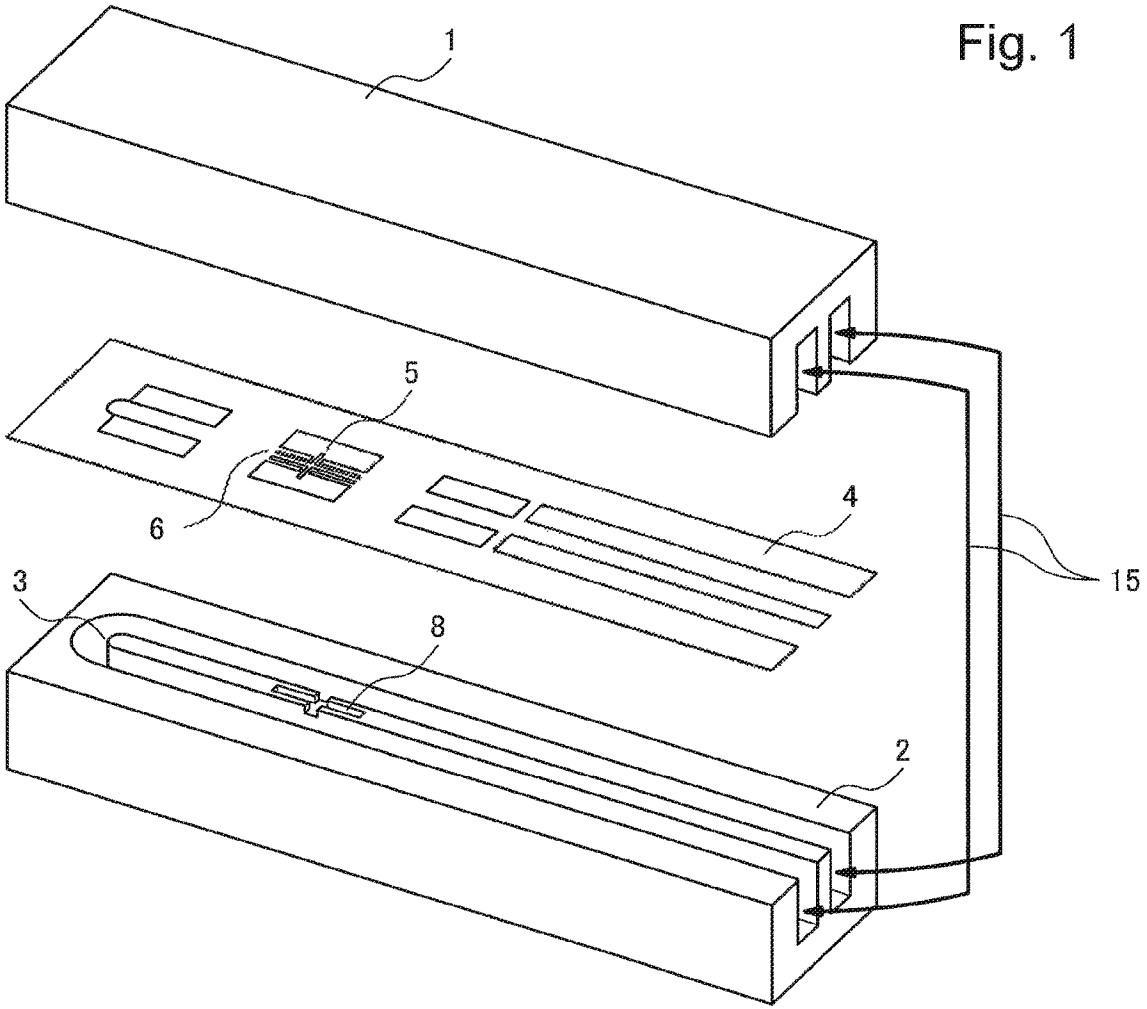
FIG. 1 is a view illustrating a configuration of a cross coupled band-pass filter in a first exemplary embodiment.

FIG. 1 is a configurational view of a six-stage band-pass filter using the present invention. As illustrated in FIG. 1, a metal plate 4 is sandwiched by waveguides 1 and 2 in which a rectangular waveguide is divided into two parts in a wide width face, and as a whole, an E-plane finline band-pass filter is configured.

Figure 4:
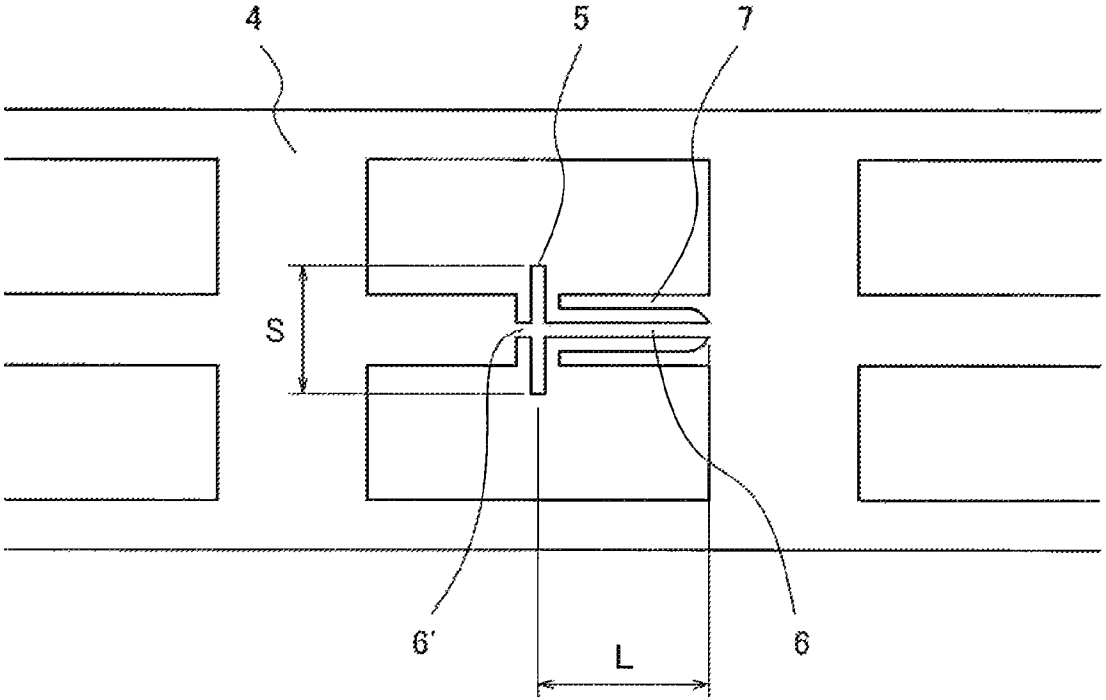
FIG. 4 is a view illustrating a periphery of a configuration of the antenna 5 of the cross coupled band-pass filter in the first exemplary embodiment.

The waveguides 1 and 2 are divided into two parts in the wide width face, but the dividing face need not be located in the center of the waveguide. Further, the dividing face is disposed vertically to a magnetic field generated inside the waveguide. In other words, the metal plate 4 divides the rectangular waveguide that is a cross coupled band-pass filter into two parts vertically to a magnetic field internally generated. In practice, the filter may be disposed so as to have a pole on an attenuation characteristic using the metal plate 4 to be described later. The band-pass filter in the present exemplary embodiment of FIG. 1 has a structure in which folding is presented at the half part of an axial length thereof. The folding location needs not be necessarily half the axial length, and folding may be performed at an arbitrary part. In addition, as illustrated in FIG. 1 and FIG. 4, the folded structure of the band-pass filter in the present exemplary embodiment includes a groove 8 in a portion facing an antenna 5 and a short stub 6 in a cross-section facing the metal plate 4 of an internal wall 3 that is a tube wall shared by internal spaces.

The metal plate 4 is designed so that a shape (a thickness of the plate, a width/distance of a metal fin) of the metal plate 4 formed into a grid configures connection coefficients necessary for the band-pass filter and the metal plate 4 resonates at a predetermined frequency. In other words, the resonator is formed with the metal plate 4 that is a filter element. In the present exemplary embodiment, the filter is configured using an input/output waveguide 15 one end of which is open when the waveguides 1 and 2 are combined and six stages of resonators therebetween. In other words, one end of the input/output waveguide 15 and the other end of the input/output waveguide 15 are connected together by the six stages of resonators. In the input/output waveguide 15, one end thereof acts as an incident waveguide and the other end thereof acts as an output waveguide, depending on the incident path of electromagnetic waves. As illustrated in FIG. 1, folding is performed between third-stage and fourth-stage resonators of a filter of six stages as a whole, and first-stage and sixth-stage resonators, second-stage and fifth-stage resonators, and the third-stage and fourth stage resonators are formed to face each other, respectively.

The second-stage and fifth-stage resonators are connected by the antenna 5 located in the center of an opening formed by the groove 8 disposed in the shared internal wall 3 when the waveguides 1 and 2 and the metal plate 4 are combined. Regarding the resonators connected by the antenna 5 in this manner, there may be at least one set of resonators adjoining via the shared internal wall 3 and being connected by the antenna 5 and the groove 8. It is possible to generate a pole when at least one resonator unconnected with another resonator by an antenna is sandwiched between one set of resonators connected by the antenna 5 in a waveguide path of electromagnetic waves in the present band-pass filter. In other words, regarding the resonators in the present invention, there may be three or more stages of resonators including one set of resonators connected by the antenna 5 as described above and a single stage resonator unconnected with another resonator.

Figure 2:
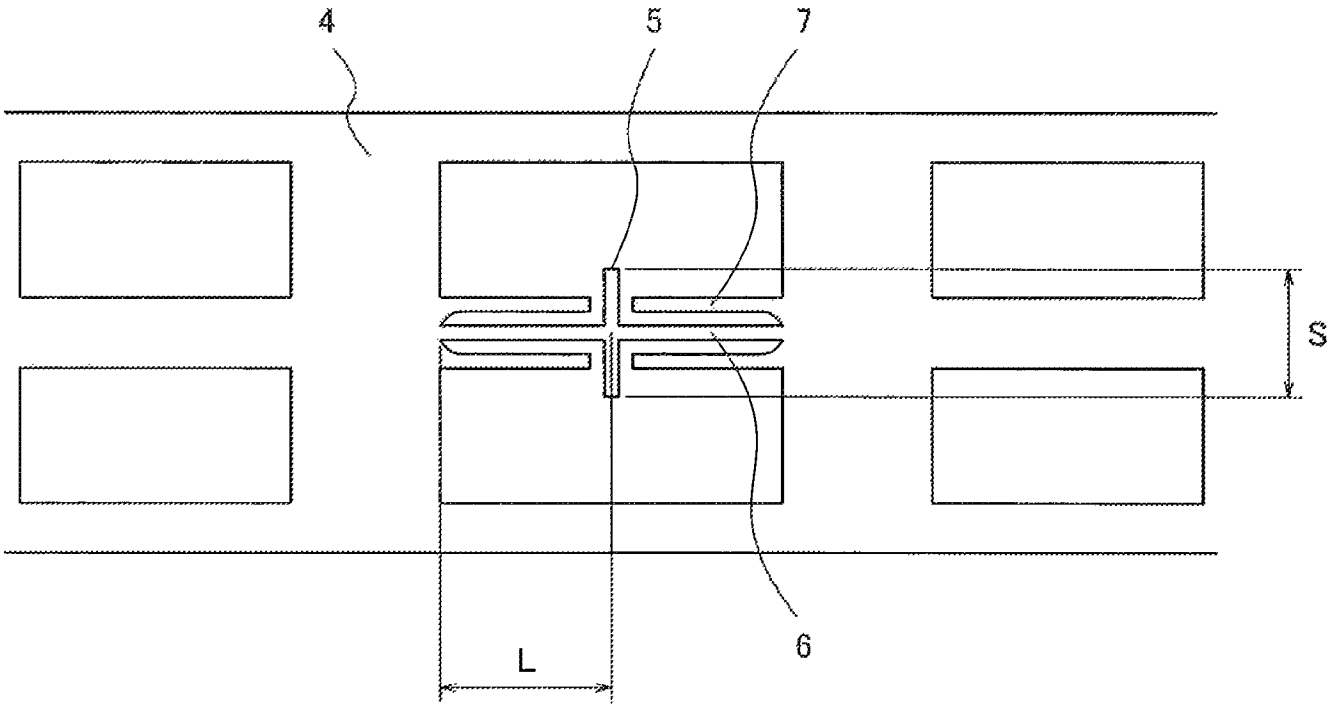
FIG. 2 is a view illustrating a configuration of a periphery of an antenna 5 of the cross coupled band-pass filter in the first exemplary embodiment.
Figure 3:
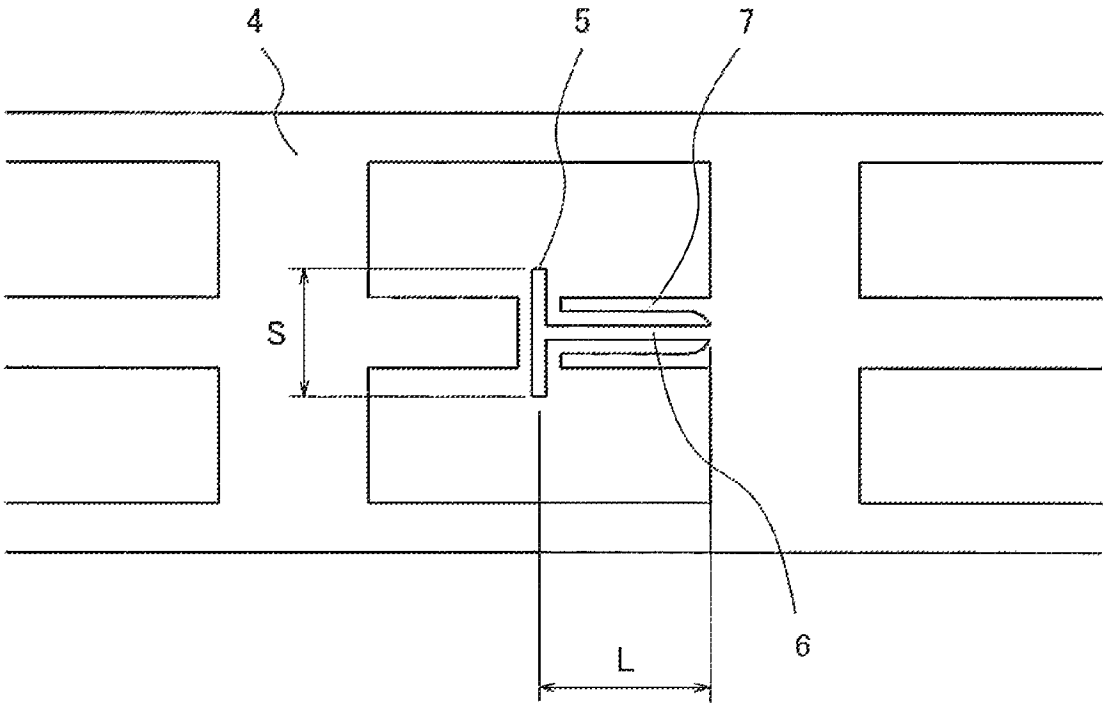
FIG. 3 is a view illustrating a periphery of a configuration of the antenna 5 of the cross coupled band-pass filter in the first exemplary embodiment.

FIG. 2 illustrates an enlarged view of a periphery of the antenna 5 generating a pole of the metal plate 5 of the metal plate 4 illustrated in FIG. 1. As illustrated in FIG. 2, both sides of the antenna 5 are connected in the center thereof with the short stub 6, and the short stub 6 is connected with the metal plate 4. As illustrated in FIG. 3, the short stub 6 may also be present only on one side when mechanical strength is maintained. Further, in a disposition as illustrated in FIG. 4, the antenna 5 may be held on both sides using short stubs 6 and 6'. One of the short stubs 6 and 6' may connect the metal plate 4 and the antenna as the short stub 6. Further, it is possible that the other one is formed as the short stub 6' only in an area facing the groove 8 that faces the antenna 5; and an area up to connection with the metal plate is connected with the metal plate 4 at a width corresponding to a thickness of the facing internal wall 3.

The short stub 6 has a length L optimized in a pass frequency band of the present cross coupled band-pass filter. In FIG. 2, the short stub 6 is connected with both ends of the antenna 5. When the present cross coupled band-pass filter is configured by combining the waveguides 1 and 2 and the metal plate 4, the groove 8 is disposed at a location facing the antenna 5 and the short stub 6 in the internal wall of the waveguides 1 and 2 (in FIG. 1, only the groove 8 of the waveguide 2 is visible).

Figure 5:
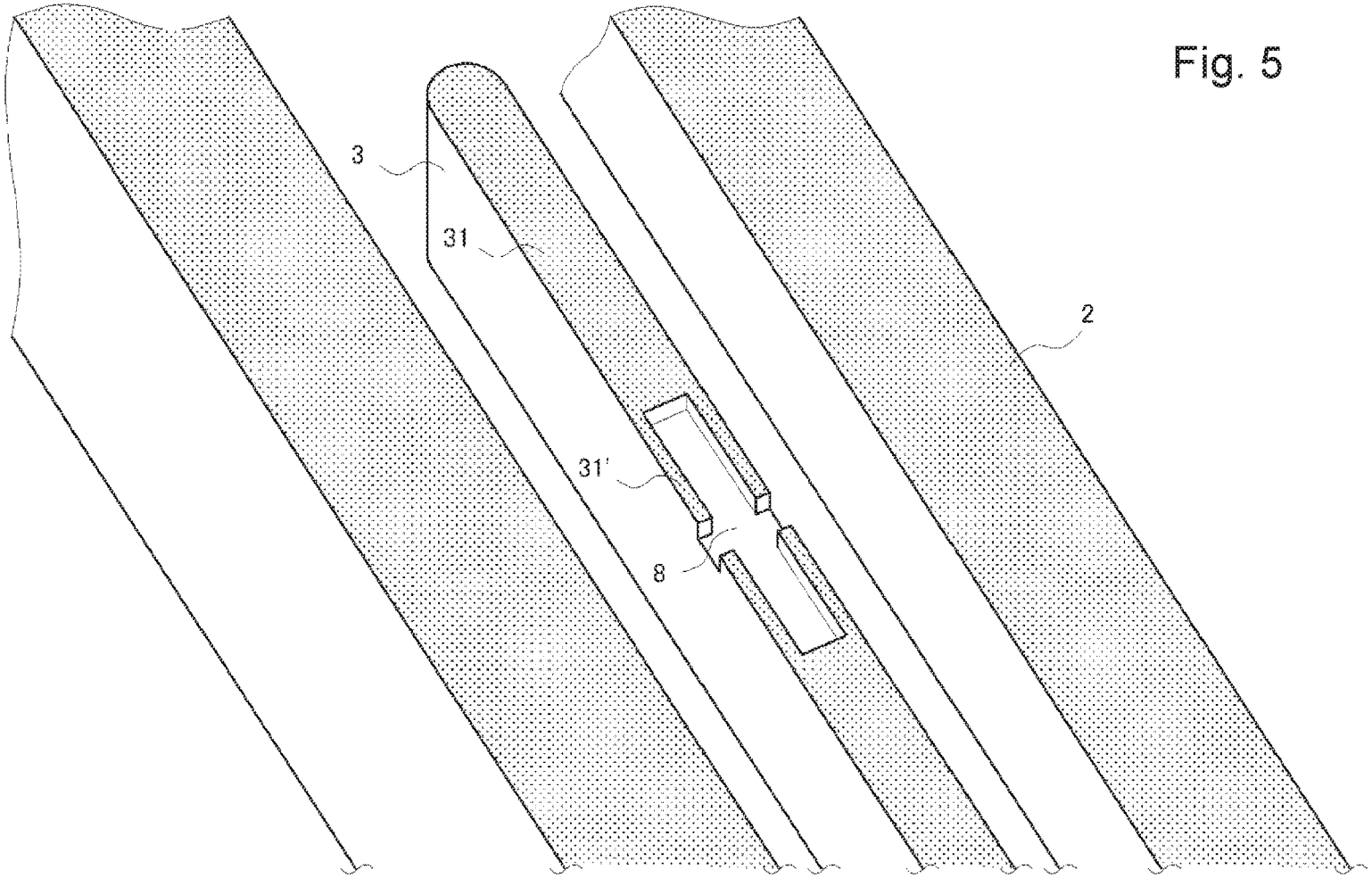
FIG. 5 is a view illustrating a configuration of a groove 8 of the cross coupled band-pass filter in the first exemplary embodiment.

FIG. 5 is an enlarged view illustrating the portion of the groove 8 illustrated in FIG. 1. The groove 8 is disposed in the waveguides 1 and 2. The groove 8 is disposed at a location facing the antenna 5 and the short stub 6 and is formed in a coaxial line with respect to the antenna 5 and the short stub 6. The groove 8 is intended to ensure a space for configuring the antenna 5 and the short stub 6 as the coaxial line. When the present cross coupled band-pass filter is configured by combining the waveguides 1 and 2 and the metal plat 4, the groove 8, specifically a portion thereof facing the antenna 5 functions as an opening for connecting two resonators adjoining across the internal wall 3. In this manner, the portion of the antenna 5 makes no contact with either of the waveguides 1 and 2 by the groove 8 and therefore is disposed in a floating state inside the opening. Further, a length S of the antenna 5 can adjust a frequency of a pole generated on an attenuation characteristic.

With regard to the metal plate 4, in an area facing a cross-section 31 of the internal wall 3 of both sides of the short stub 6, a outer conductor 7 is disposed. When the present cross coupled band-pass filter is configured by combining the waveguides 1 and 2 and the metal plate 4, the outer conductor 7 and an internal wall cross-section 31' of the outside of the groove 8 make close contact with each other, and therefore a gap can be prevented from being carelessly generated in a periphery of the antenna 5. As a result, it is possible to prevent unnecessary electric waves from being generated between two resonators connected across the antenna 5.

Description of Advantageous Effects

As described above, in the cross coupled band-pass filter in the first exemplary embodiment of the present invention, the antenna 5 is disposed on the metal plate 4 that is a filter element, and thereby a pole can be generated in a pass frequency band. Further, also upon exchanging the metal plate 4 to change a resonance frequency, when the antenna 5 suitable for the metal plate 4 having a new resonance frequency is previously mounted, an adjustment after mounting in the present cross coupled band-pass filter becomes unnecessary. Further, the metal plate 4 is used as a filter element, and therefore a loss of a signal due to a dielectric loss can be reduced.

Example

Figure 6:
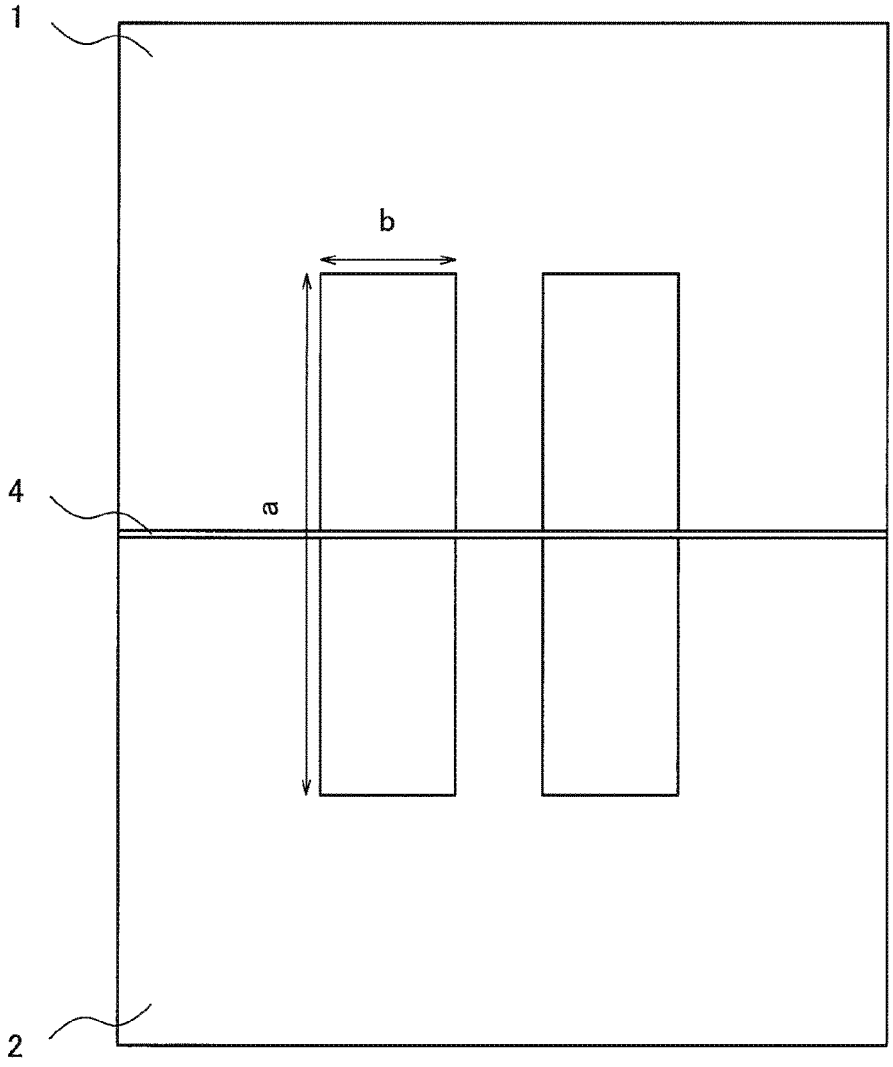
FIG. 6 is a view illustrating a cross-section and an internal dimension with respect to waveguides 1 and 2 and a metal plate 4 in an example.
Figure 7:
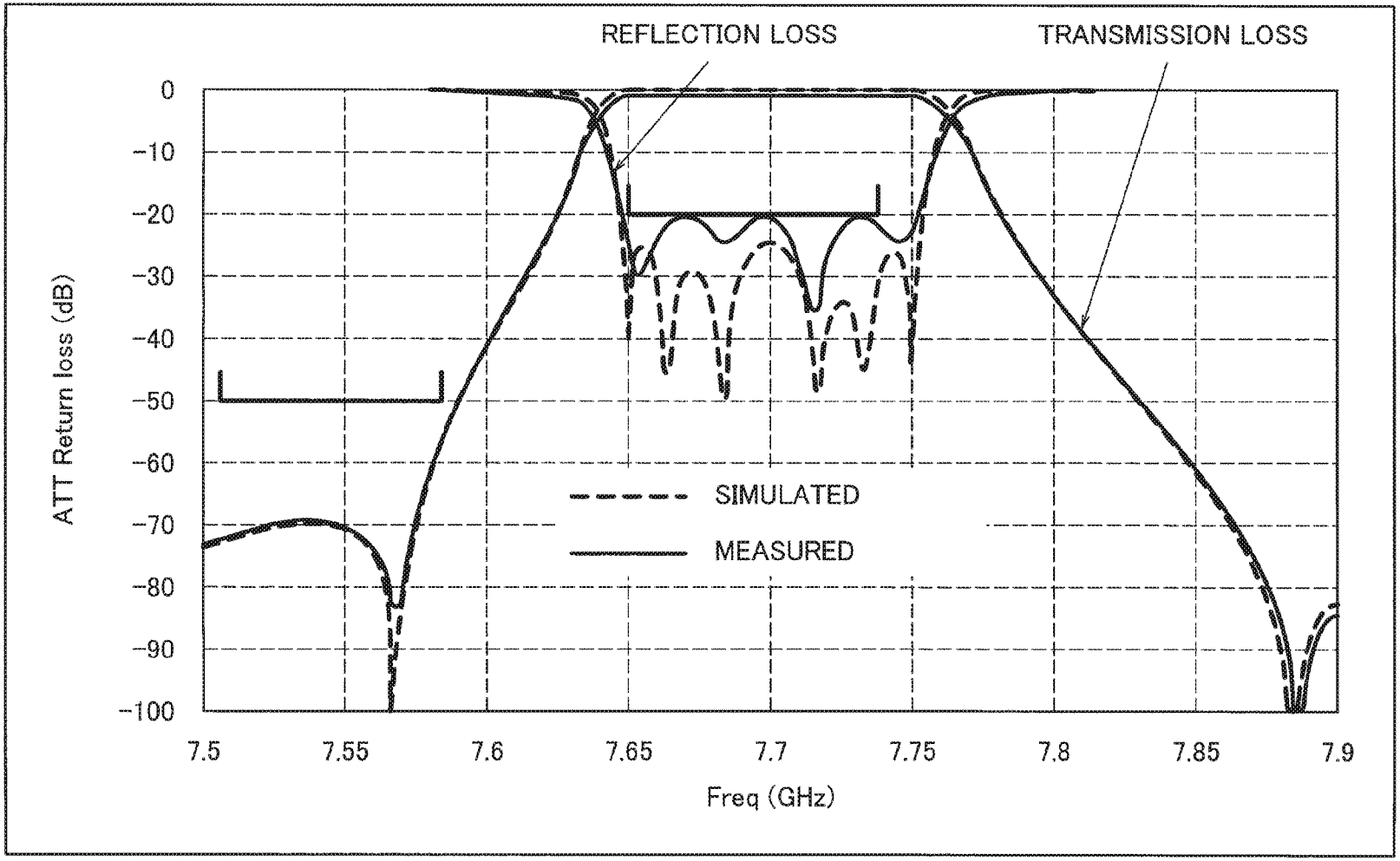
FIG. 7 is a chart illustrating a measurement result in an example of the first exemplary embodiment.

FIG. 6 illustrates a cross-section and an internal dimension ($a \times b = 28.5 \times 12.6$ mm$^2$) of one example in which a six-stage cross coupled band-pass filter is configured in a 7 GHz band, and FIG. 7 illustrates calculated values and measured values in a characteristic under the condition. In FIG. 7, the vertical axis indicates transmission loss (ATT/dB) and reflection loss (Return loss/dB), and the horizontal axis indicates pass frequency (Freq/GHz). In the vertical axis of FIG. 7, a negative value indicates a loss of a signal. Regarding values in FIG. 7, a solid line represents measured values and a dashed line represents calculated values. Further, a represents a length of an electromagnetic-wave propagation direction of an H plane that is a plane parallel to a direction of a magnetic field vector inside a rectangular waveguide. In addition, b represents a length of an E plane that is a plane parallel to a direction of an electric field vector inside the rectangular waveguide.

In the case of the present example, in the same manner as in the first exemplary embodiment, a second stage and a fifth stage of the cross coupled band-pass filter are connected, and thereby a pole is generated on a higher side and a lower side of a pass frequency band. Further, the metal plate 4 is disposed at a location dividing the waveguide into two equal parts.

As illustrated in FIG. 7, a reflection loss under this condition is indicated as a favorable value of at least 20 dB, and therefore it is conceivable that the antenna 5 does not affect a pass characteristic of the band-pass filter.

Second Exemplary Embodiment

In the first exemplary embodiment, the antenna 5 is disposed at one location of the cross coupled band-pass filter. The present exemplary embodiment will describe an example in which another antenna 5' is disposed in the first exemplary embodiment.

Figure 8:
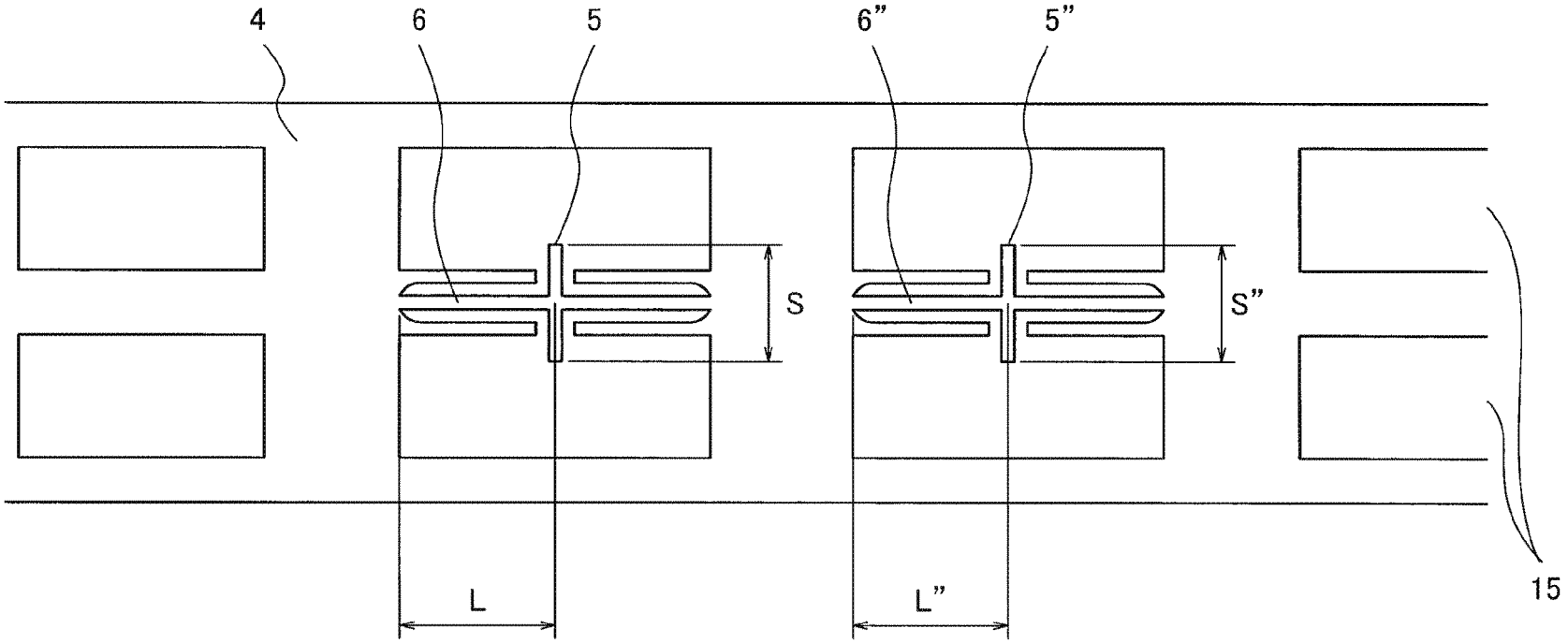
FIG. 8 is a view illustrating a configuration of a periphery of an antenna 5 of a cross coupled band-pass filter in a second exemplary embodiment.
Figure 9:
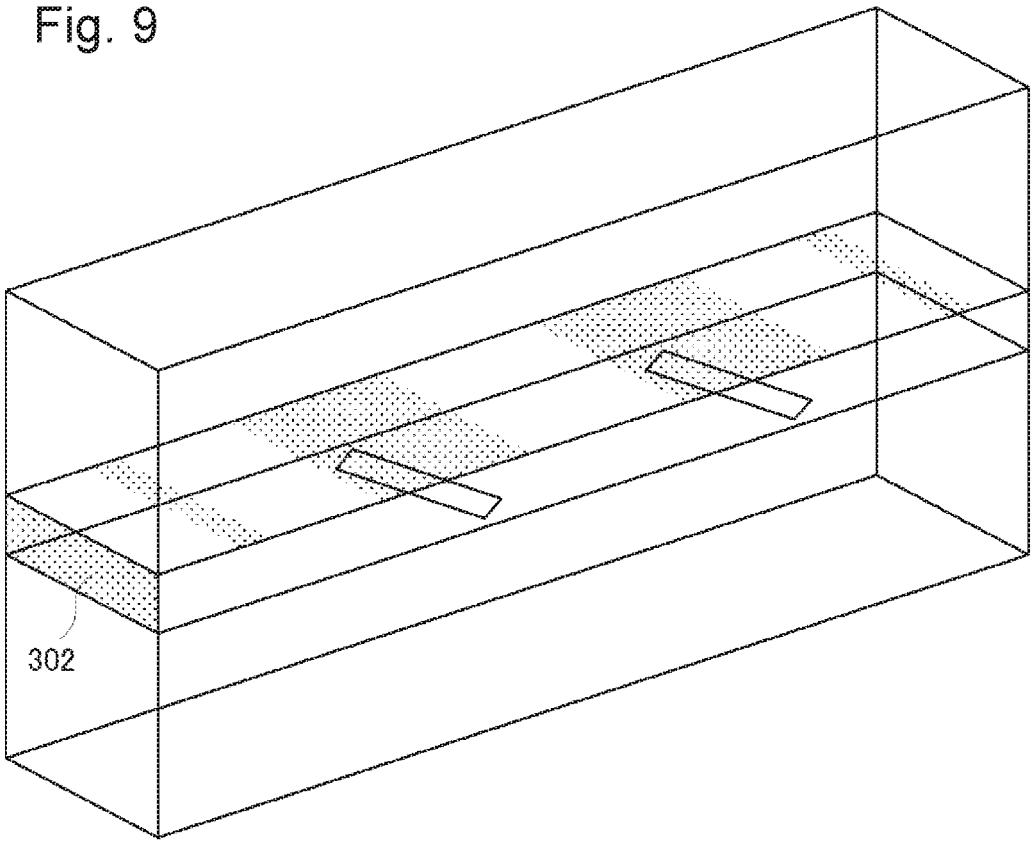
FIG. 9 is a view illustrating an E-plane finline band-pass filter described in PTL 1.
Figure 10:
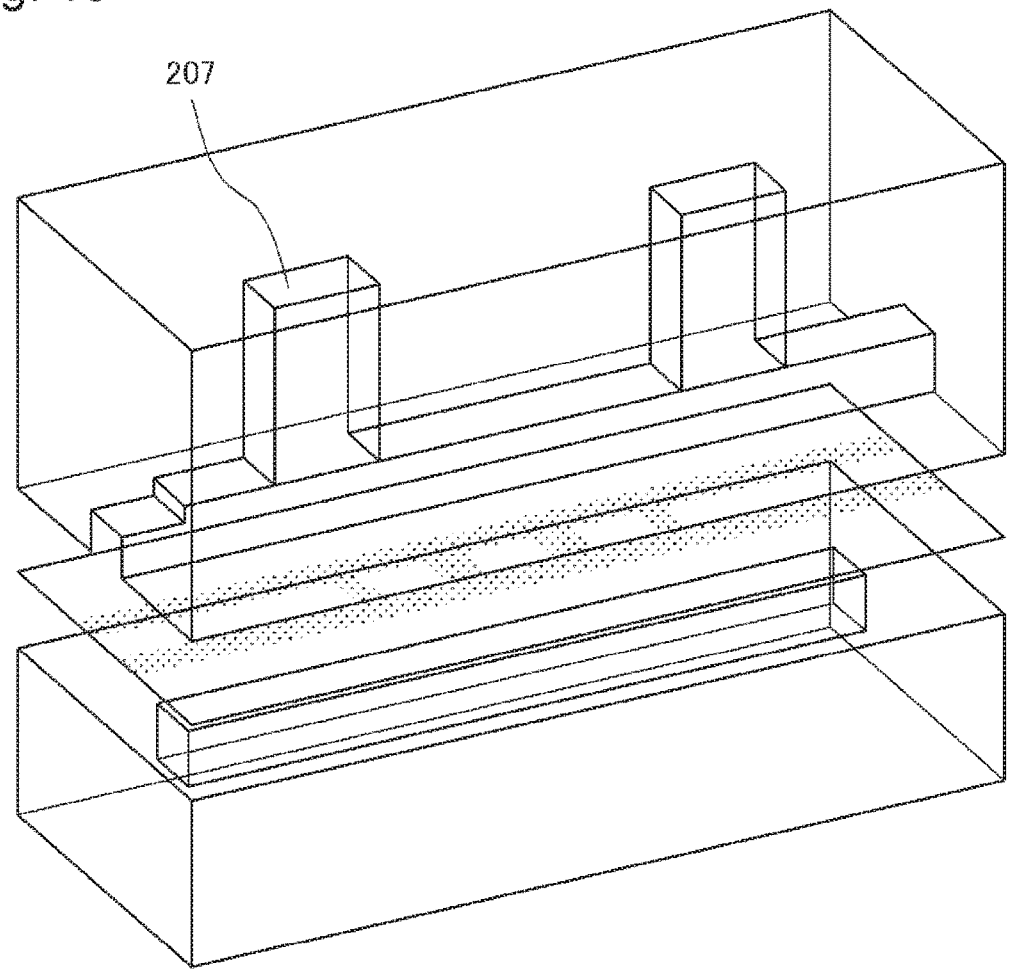
FIG. 10 is a view illustrating an E-plane finline band-pass filter described in PTL 2.
Figure 11:
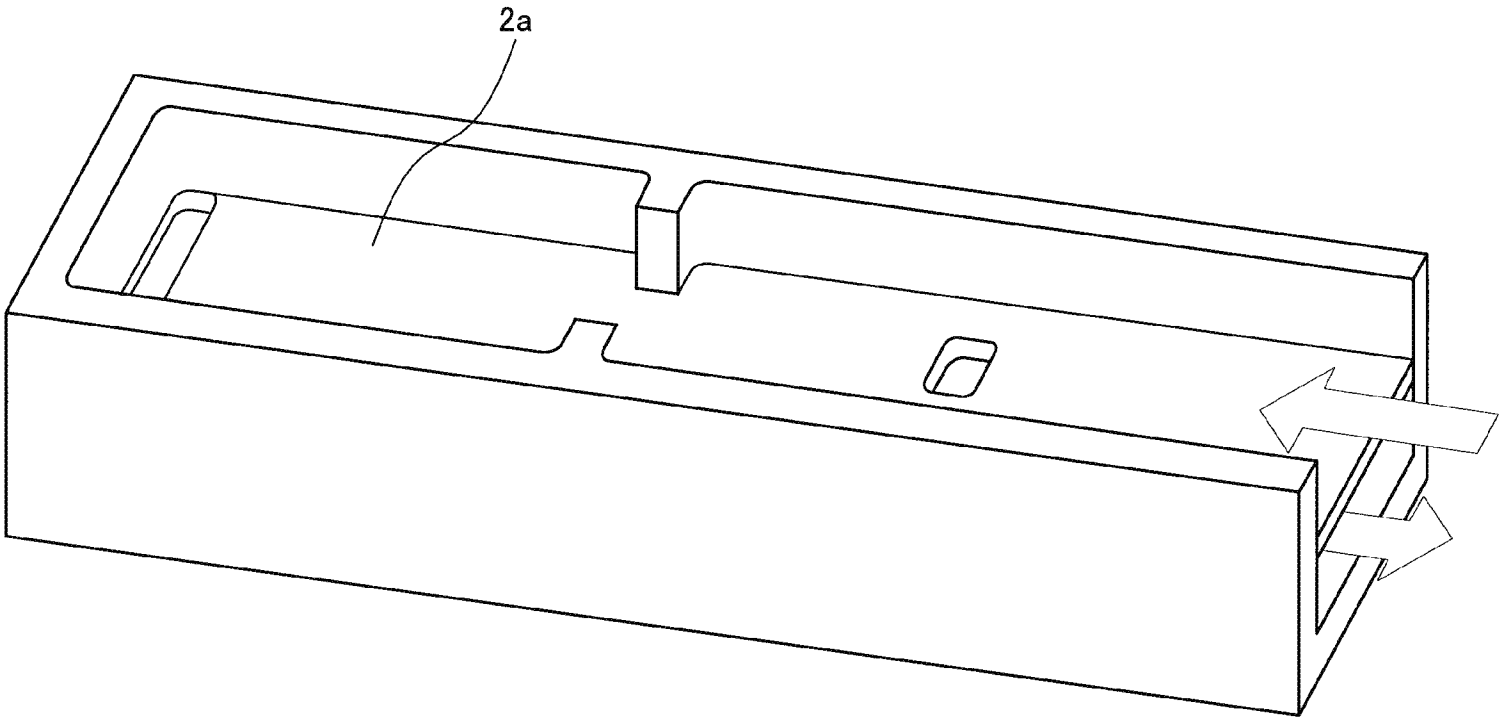
FIG. 11 is a view illustrating an E-plane finline band-pass filter described in PTL 3.

FIG. 8 is a configurational view of a six-stage band-pass filter including two antennas 5 and 5" according to the present exemplary embodiment. Differently from the first exemplary embodiment, in the metal plate 4 of the present exemplary embodiment, first-stage and sixth stage resonators are also connected by the groove 8 of the shared internal wall 3 and the antenna 5" in the same manner as second-stage and fifth-stage resonators. FIG. 8 also illustrates the input/output waveguide 15.

The two antennas 5 and 5" have different lengths S and S", respectively. This makes it possible to generate a plurality of poles. Each of lengths L and L" of short stubs 6 and 6", respectively, is optimized as a length that does not affect an electric characteristic.

A condition for generating a pole is that in a waveguide path of electromagnetic waves, at least one resonator unconnected with another resonator by an antenna is sandwiched between one set of resonators connected by the antenna 5. Disposition of the antenna 5 at two or more locations also makes it possible to add the number of poles on an attenuation characteristic by the same operation.

In the present exemplary embodiment, the antennas 5 and 5" are disposed at two locations of the band-pass filter. In other words, when the number of the antennas 5 is increased by one, one set of poles can be added. Even when the antenna 5 is disposed at three or more locations, the number of poles on the attenuation characteristic can be added by the same operation.

Another Exemplary Embodiment

The above description has exemplified the exemplary embodiments and the example in which folding is performed twice along the axial length of the present filter, but the folding can be performed twice or more.

The present invention has been described with reference to the exemplary embodiments (and the example), but the present invention is not limited to the exemplary embodiments (and the example). Various modifications which can be understood by those skilled in the art can be applied to the constitution and details of the present invention, without departing from the scope of the present invention.

This application is based upon and claims the benefit of priority from Japanese patent application No. 2013-040978, filed on Mar. 1, 2013, the disclosure of which is incorporated herein in its entirety by reference.

REFERENCE SIGNS LIST

1 waveguide
2 waveguide
3 internal wall
4 metal plate
5, 5" antenna
6, 6', 6" short stub
7 outer conductor
8 groove
15 input/output waveguide
31 cross-section of internal wall 3
31' internal wall cross-section of outside of groove 8
302 dielectric substrate

The invention claimed is:

1. A cross coupled band-pass filter comprising:
an input waveguide;
an output waveguide; and
three or more stages of resonators that connect the input and output waveguides together,
wherein the three or more stages of resonators are formed using:
a filter element,
one or multiple pairs of resonators of the three or more stages of resonators that adjoin via a shared tube wall and include an opening in the shared tube wall,
an antenna that connects the one or multiple pairs of resonators together in the opening, and
one or more stages of unconnected resonators between the one or multiple pairs of resonators in a waveguide path of electromagnetic waves,
wherein the three or more stages of resonators comprise a resonator waveguide divided into a first waveguide portion and a second waveguide portion along the waveguide path, and the antenna is sandwiched between the first waveguide portion and the second waveguide portion.

2. The cross coupled band-pass filter according to claim 1, wherein
the antenna is connected with the filter element using one or two short stubs, and
a pole outer conductor connected with the filter element is disposed between the one or two short stubs and the resonators connected by the antenna.

3. The cross coupled band-pass filter according to claim 1, wherein the filter element is a metal plate.

4. The cross coupled band-pass filter according to claim 1, wherein a folding is presented at a half part of an axial length of the filter.

* * * * *